US007690674B2

(12) United States Patent
Trimble et al.

(10) Patent No.: US 7,690,674 B2
(45) Date of Patent: Apr. 6, 2010

(54) SNOW RIDING IMPLEMENT

(75) Inventors: Alan Trimble, Laguna Nigel, CA (US); Brian H. C. Smith, Newport Beach, CA (US)

(73) Assignee: Armada Skis, Inc., Costa Mesa, CA (US)

( * ) Notice: Subject to any disclaimer, the term of this patent is extended or adjusted under 35 U.S.C. 154(b) by 684 days.

(21) Appl. No.: 11/463,828

(22) Filed: Aug. 10, 2006

(65) Prior Publication Data

US 2008/0042400 A1 Feb. 21, 2008

(51) Int. Cl.
*A63C 5/04* (2006.01)

(52) U.S. Cl. ..... 280/609; 280/602

(58) Field of Classification Search ..... 280/11.18, 280/601, 602, 605–610
See application file for complete search history.

(56) References Cited

U.S. PATENT DOCUMENTS

| | | | | | |
|---|---|---|---|---|---|
| 405,516 | A | | 6/1889 | Watson | |
| 2,071,220 | A | * | 2/1937 | Schniebs | 280/609 |
| 3,096,530 | A | | 7/1963 | Almgren | |
| 3,173,161 | A | * | 3/1965 | Amsbry | 441/68 |
| 3,272,522 | A | | 9/1966 | Kennedy, Ill | |
| 3,747,947 | A | * | 7/1973 | Gunzel | 280/602 |
| 3,827,096 | A | * | 8/1974 | Brownson | 441/68 |
| 4,085,947 | A | | 4/1978 | Sarver | |
| 4,300,786 | A | | 11/1981 | Alley | |
| 4,343,485 | A | | 8/1982 | Johnston et al. | |
| 4,377,297 | A | * | 3/1983 | Staufer | 280/609 |
| 4,487,426 | A | | 12/1984 | Nishizawa | |
| 4,568,100 | A | | 2/1986 | Eriksson | |
| 4,700,967 | A | * | 10/1987 | Meatto et al. | 280/609 |
| 4,705,291 | A | | 11/1987 | Gauer | |
| 4,706,985 | A | | 11/1987 | Meatto | |
| 4,715,612 | A | * | 12/1987 | Fels et al. | 280/609 |
| 4,731,038 | A | | 3/1988 | Hancock et al. | |
| 4,756,544 | A | * | 7/1988 | Abondance et al. | 280/609 |
| 4,953,884 | A | * | 9/1990 | Diard et al. | 280/609 |
| 4,961,592 | A | * | 10/1990 | Diard et al. | 280/609 |
| 4,971,349 | A | * | 11/1990 | Diard et al. | 280/609 |
| 4,995,631 | A | * | 2/1991 | Hunter | 280/607 |
| 5,096,217 | A | * | 3/1992 | Hunter | 280/607 |
| 5,230,527 | A | * | 7/1993 | Varan | 280/609 |
| 5,242,187 | A | * | 9/1993 | Diard et al. | 280/609 |
| 5,280,943 | A | * | 1/1994 | Commier et al. | 280/609 |
| 5,286,051 | A | * | 2/1994 | Scherubl | 280/607 |
| 5,320,377 | A | * | 6/1994 | Ruffinengo | 280/602 |
| 5,335,931 | A | * | 8/1994 | Lacroix et al. | 280/602 |
| 5,375,868 | A | | 12/1994 | Sarver | |

(Continued)

FOREIGN PATENT DOCUMENTS

| | | |
|---|---|---|
| EP | 1484091 | 12/2004 |

(Continued)

*Primary Examiner*—Paul N Dickson
*Assistant Examiner*—Vaughn T Coolman
(74) *Attorney, Agent, or Firm*—Black Lowe & Graham PLLC

(57) ABSTRACT

A ski in accordance with the invention increases in width from a tip or shovel portion to a mid-portion. The mid-portion includes at least a slight sidecut. The ski then decreases in width from the mid-portion to a tail portion. The ski also includes an undersurface with a substantial portion being rockered. A substantial portion of the mid-portion of the ski is not rockered.

36 Claims, 5 Drawing Sheets

U.S. PATENT DOCUMENTS 5,405,161 A * 4/1995 Petkov ..... 280/609
5,524,912 A 6/1996 Laub et al.
5,560,632 A 10/1996 Gauer
D375,341 S * 11/1996 Andrevon et al. ..... D21/766
5,603,522 A 2/1997 Nelson
5,667,238 A 9/1997 Sarver
5,820,154 A * 10/1998 Howe ..... 280/602
5,823,562 A 10/1998 Stubblefield
5,868,405 A 2/1999 Lavecchia et al.
5,871,225 A * 2/1999 Sutherland ..... 280/609
5,876,056 A 3/1999 Karlsen
6,000,711 A * 12/1999 Fey et al. ..... 280/603
6,079,746 A * 6/2000 Olsen ..... 280/809
6,105,991 A 8/2000 Dodge et al.
6,182,998 B1 * 2/2001 Huyghe et al. ..... 280/602
6,241,272 B1 * 6/2001 Hammerle ..... 280/609
6,357,782 B1 * 3/2002 Pieber et al. ..... 280/609
6,631,918 B2 * 10/2003 Silva ..... 280/607
6,857,653 B2 * 2/2005 Wilson ..... 280/602
6,986,525 B2 1/2006 Liard
7,360,782 B2 * 4/2008 Gignoux ..... 280/602
7,396,036 B2 * 7/2008 Barbieri et al. ..... 280/601
7,419,179 B2 * 9/2008 Zanco et al. ..... 280/602
2001/0052679 A1 * 12/2001 Stubblefield ..... 280/14
2003/0006584 A1 * 1/2003 Carlson ..... 280/609
2003/0141700 A1 7/2003 Turner et al.
2003/0234513 A1 * 12/2003 Zanco ..... 280/602
2006/0145451 A1 * 7/2006 Wilson ..... 280/602

FOREIGN PATENT DOCUMENTS

WO 03/039686 3/2003

* cited by examiner

SNOW RIDING IMPLEMENT

FIELD OF THE INVENTION

This invention relates generally to snow skis and snowboards and, more specifically, to snow skis and snowboards with longitudinal rocker and modified sidecut.

BACKGROUND OF THE INVENTION

Modern skis typically include sidecuts to facilitate turning. A majority of the undersurface of the ski also includes an upward camber from the tail and shovel to the mid portion of the ski. When the ski is turned onto its edge the shovel and tail are flexed upwardly relative to the mid portion of the ski, inasmuch as they protrude laterally more than the central portion of the ski, due to the sidecut. The flexing of the shovel and tail cause the ski to bend into an arc, which in turn causes the ski to turn. The ski sidecut particularly suits the ski for packed snow where the sharp edge of the ski can be driven into the snow when turning, the downward force of the ski on the snow surface bending the camber out of the ski and causing the ski to arc. The pre-cambered ski helps distribute the load more evenly along the length of the ski.

Some skis have been developed for use in powder snow, where gripping with the edge of the ski is minimized or not needed. Such skis may have a convex undersurface (or "reverse camber") and convex sidewalls (reverse sidecuts) to facilitate maneuverability in the powder snow and provide a stable platform with good floatation. Skis designed in this way for powder are typically extremely awkward on hard snow. It is very difficult to turn a ski with convex lower surface and convex sidewalls on hard snow. For this reason, conventional powder skis are simply constructed like conventional sidecut skis, only wider. However, such skis are typically not easy to maneuver in deep powder.

In many instances skis adapted for powder will nonetheless need to be used on hard snow. A skier may ski on slopes covered in powder most of the time, but at other times be required to ski on packed snow, such as high-traffic areas at the base of the slope, when returning to the lift, or around a ski lodge. A skier anticipating powder may also find that the snow has been packed out.

Accordingly, it would be an advancement in the art to provide a ski adapted for skiing on powder snow that also handles well on hard snow.

SUMMARY OF THE INVENTION

The ski or snowboard (or other snow riding device) includes edges running along its sides between forward and rearward ends. The ski includes a tip and a tail. A mid-portion has a waist, a forward end, and a rearward end. The waist has a width smaller than the average of the widths of the forward and rearward ends of the mid-portion, such that a sidecut is created along the mid-portion. A fore-body and an aft body are on either side of the mid-portion. The rearward end of the fore-body meets the forward end of the mid-portion. The forward end of the fore-body meets the tip. The fore-body is wider at its rearward end than at its forward end. The aft-body is positioned between the mid-portion and the tail. It is wider at its forward end than at its rearward end.

A ski in accordance with one embodiment of the invention has an undersurface some or all of which is rockered. The sidecuts (including sidewalls and edges) of the ski are generally convex or straight along the length of the ski. Near the middle portion, preferably at least in the binding region, the sidecut includes concave portions. In some embodiments, the undersurface is generally convex with a substantially planar portion corresponding to the location of the concave portions of the sidecut or the binding region. The concave portions preferably have a length equal to between 20% and 60% of the total length of the ski. In other embodiments, the concave portion has a length equal to between about 25% and 35% of the total length of the ski. In the preferred embodiment of the invention, the concave portion has a length equal to about 30% of the total length of the ski.

At the narrowest point of the ski within the concave mid-portions, the ski has a width between 1% and 10% less than a widest point of the ski. In other embodiments, the narrowest point near the concave portions has a width between 1.2% and 5% less than the widest point of the ski. In the preferred embodiment, the narrowest point near the concave portions is about 1.5% less than the width of the widest point of the ski.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1A:
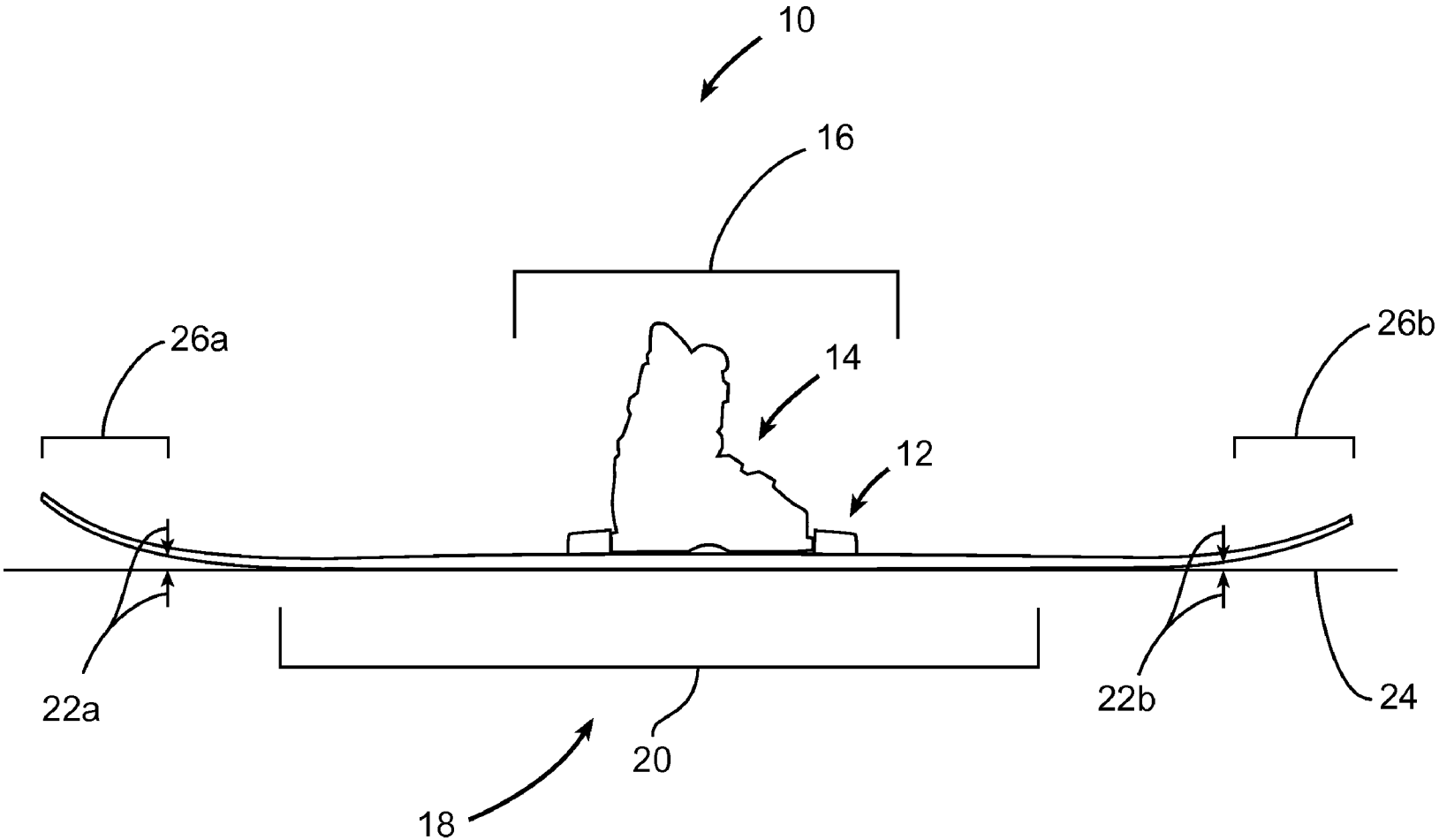
FIGS. 1A and 1B are side views of skis, in accordance with embodiments of the present invention.
Figure 1B:
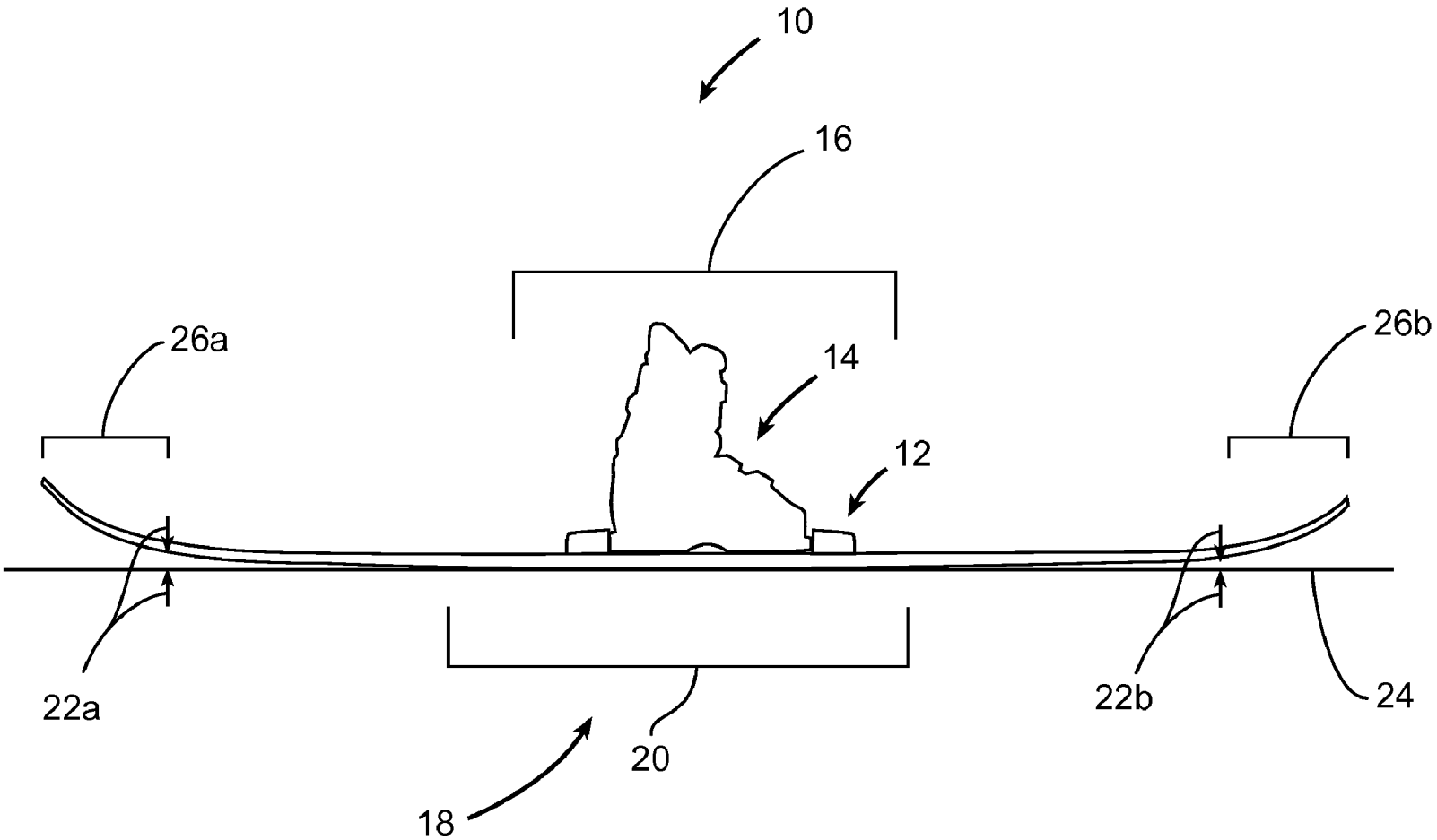

Referring to FIGS. 1A and 1B, a ski 10 bears a binding 12 for receiving a user's ski boot 14. The ski includes a binding portion or mid-portion 16 near the center of the ski 10. The sides of the mid-portion of the ski include at least a slight sidecut. The binding 12 secures to an upper surface of the mid-portion 16. The undersurface 18 is typically rockered (convex), although in some embodiments the undersurface 18 has the typical concave camber of traditional skis. Proximate the mid-portion 16 the undersurface 18 preferably has a substantially planar portion 20. The planar portion 20 may be coextensive with the binding portion 16, be shorter or longer than the binding portion 16, or be offset from the binding portion 16. In the embodiment of FIG. 1A, the planar portion 20 is much longer than the mid-portion 16. In the embodiment of FIG. 1B, the convexity of the undersurface 18 is much more pronounced and the planar portion 20 is much shorter or eliminated. In some embodiments, the planar portion 20 is replaced by a region of reduced convexity, such that the entire undersurface 18 is rockered.

Near the ends of the ski, the undersurface 18 is a distance 22*a*, 22*b* above a plane 24 parallel to the planar portion 20 due to the convexity of the undersurface 18. The distance 22*b* at the forward end of the ski 10 is preferably less than the distance 22*a* at the rearward end. For example, a 185 cm ski may have a distance 22*a* of 2 cm and a distance 22*b* of 1.5 cm.

Raised tail and tip portions 26*a*, 26*b* are formed at the rearward and forward ends of the ski 10, respectively. A fore-body portion lies between the tip portion 26*b* and the mid-portion 16, while an aft-body portion lies between the tail portion 26*a* and the mid-portion of the ski. The raised portions 26*a*, 26*b* typically have a slope substantially greater than the remainder of undersurface 18. For example, a 185 cm ski may have a tail portion 26*a* having a length of 18.45 cm and a height of 5.98 cm. The tip portion 26*a* of such a ski 10 may have a length of 18.45 cm and a height of 5 cm.

In some embodiments, the tail portion 26*a* is higher than the tip portion 26*a*. Increasing the height of the rearward tail portion enables a skier to more easily ski and land jumps backwards. Inasmuch as a skier normally has much better balance and control when skiing and landing facing forward, increasing the height of the tail portion 26*a* helps the skier avoid burying the tail portion 26*a* in the snow.

Figure 2:
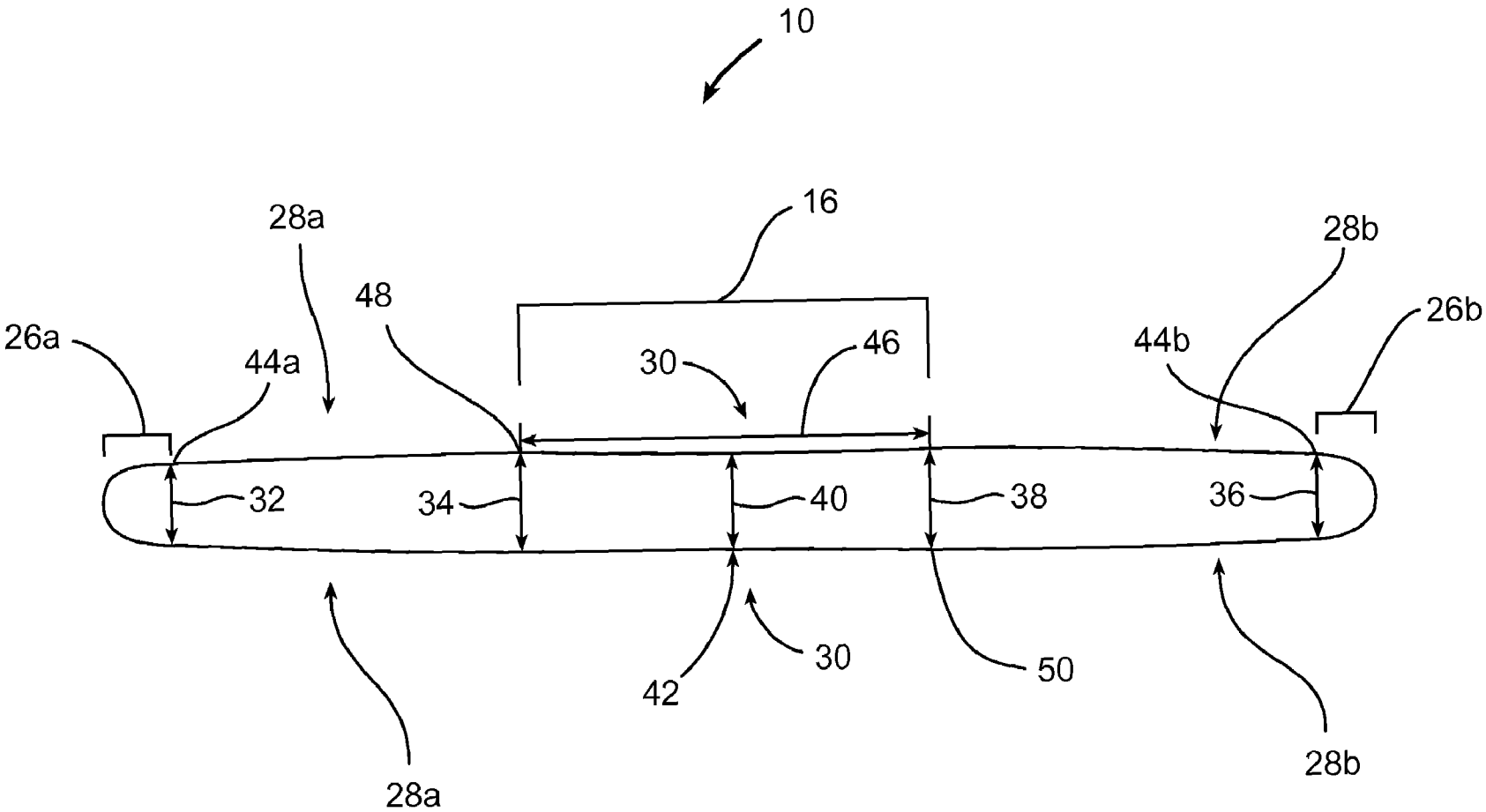
FIG. 2 is top view of a ski, in accordance with an embodiment of the present invention.

Referring to FIG. 2, the ski 10 includes straight, or in some embodiments convex (i.e. reverse sidecut), sidewalls 28*a*, 28*b* extending along the fore- and aft-body portions from the raised portions 26*a*, 26*b* toward the mid-portion 16 of the ski. Concave (i.e. sidecut) sidewalls 30 are located near the binding mounting location in the mid-portion of the ski 16. In one preferred embodiment the concave sidewalls 30 coincide with the binding mounting region. However, the concave sidewalls 30 may be either longer or shorter than the binding mounting region. The concave sidewalls 30 may also be offset in front or behind the binding region. In a like manner, the concave sidewalls 30 may be coextensive with the planar portion 20, be longer or shorter than the planar portion 20, and be offset in front or behind the planar portion 20.

The sidewalls 28*a* of the aft-body portion are separated by a width 32 near the tail portion 26*a* that is substantially less than a separation width 34 near the boundary between the straight or convex sidewalls 28*a* and the concave sidewalls 30 of the mid-portion 16. In a like manner, the sidewalls 28*b* of the fore-body are separated by a width 36 near the tip portion 26*b* that is substantially less than the width 38 near the boundary between the fore-body and the mid-portion 16.

In the preferred embodiment, the width 38 is greater than the width 34. The width 36 is also preferably greater than the width 32, such that the shovel of the ski 10 is wider than the tail. For example, in a 185 cm ski the width 38 may be 135 mm whereas the width 34 is 134 mm. In the same ski, the width 36 may be 125 mm whereas the width 32 is 120 mm.

The concave sidewalls 30 of the mid-portion 16 are separated by a waist width 40 generally at a narrowest point 42 of the ski (or at the deepest sidecut) along the concave sidewalls 30. The concave sidewalls 30 may describe an arcuate path or may describe straight lines from endpoints 44*a*, 44*b* of the concave sidewalls to the narrowest point 42. In any case, the waist has a width less than the average of the widths 38 and 34, such that a sidecut is formed.

The concave sidewalls 30 along the mid-portion 16 have a length 46 that is substantially less than the entire length of the ski 10. In some embodiments, the length 46 is between about 20% and about 60% of the total length of the ski 10. In other embodiments, the length 46 is between about 25% and about 40% of the total length of the ski 10. In still other embodiments, the concave portion forms about 32% of the total length of the ski. For example, in a 185 cm ski, the concave portion may have a length of 60 cm centered on the middle of the ski 10. The length 46 of the concave sidewalls 30 may also be chosen to be substantially equal to a length of the binding 12 secured to the ski 10.

The waist width 40 of the concave sidewalls 30 is typically between 1% and 20% less than either the width 38 at the boundary between the sidewalls 28*b* and the concave sidewalls or the width of the widest point of the ski. In other embodiments, the waist width 40 is between 1.2% and 5% less than the widest point of the ski or the width 38. In still other embodiments, the waist width 40 is about 1.5% less than the widest point of the ski or the width 38. For example, in a 185 cm ski, the width 40 may be 133 mm whereas the width 38 is 135 mm.

Figure 3:
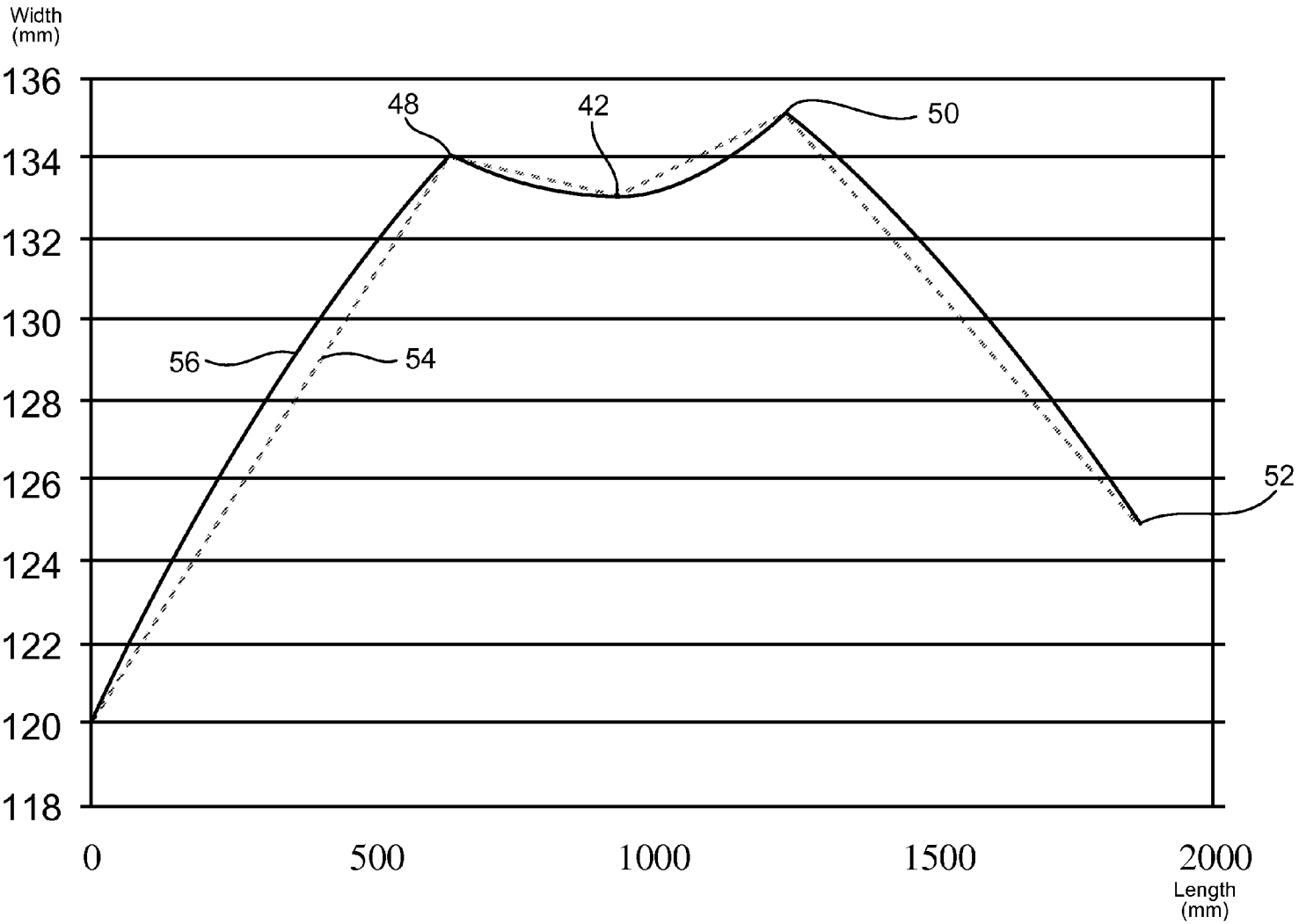
FIG. 3 is a plot of width versus length for a ski formed in accordance with an embodiment of the present invention.

FIG. 3 is a scaled graph showing the width of the ski 10 with respect to distance along the length of the ski. The width of the ski has been scaled to illustrate the variations in the width of the ski 10. As is apparent from the graph, the width of the ski 10 increases with distance from the tail to a point 48 at the boundary between the sidewalls 28*a* and the concave sidewalls 30. The width then decreases until the narrowest point 42. From the narrowest point 42, the width increases up to the point 50 at the boundary between the concave sidewalls 30 and the sidewalls 28*b*. The width then decreases smoothly until point 52 just before the tip portion 26*a*.

In any of the ski regions, the width may increase with a constant slope as shown by plot 54 or have variable slope as shown in plot 56 such that the sidewalls 28*a*, 28*b*, the concave sidewalls 30, or both, are arcuate in shape. There may be inflection points within the sidewalls 28*a*, 28*b* such that the rate at which the width increases with distance along the ski varies. Where the onvex sidewalls 28*a*, 28*b* contain inflection points, portions of the sidewalls 28*a*, 28*b* may be concave. For example, the rate at which width increases may be less near the raised portions 26*a*, 26*b* than near the concave sidewalls 30 or at another point along the sidewalls 28*a*, 28*b*.

The novel sidewalls of the ski 10 disclosed herein provide a ski that is suitable for skiing on both powder and hard snow. The concave sidewalls 30, although relatively short (compared to a conventional ski) and having a relatively slight concavity, enable a skier to use the edge of the ski to turn on hard snow. At the same time, the relatively small extent of the concave sidewalls 30 does not detract significantly from the performance of the ski in powder. The area of the ski located under the foot of the user is not greatly reduced resulting in a broad support surface when landing jumps. A broad support area is beneficial in reducing the extent to which a skier sinks into the snow on landing or downwardly pressuring the ski and therefore reducing the likelihood that the edge of the ski will catch on the snow to throw the ski sideways and cause the skier to fall.

Figure 4:
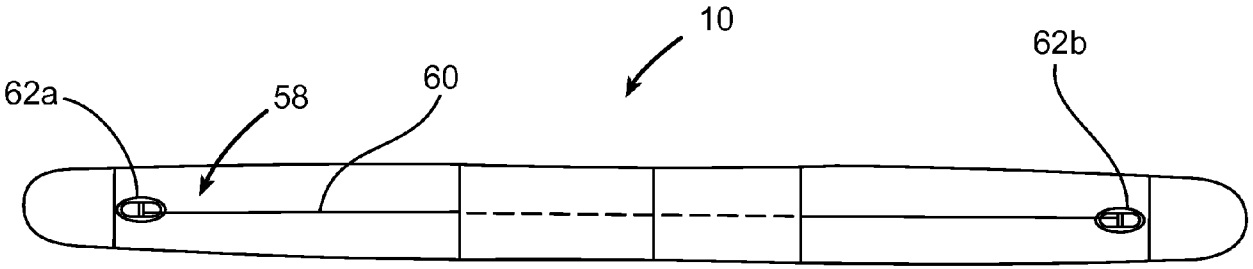
FIG. 4 is a top view of a ski having adjustable camber, in accordance with an embodiment of the present invention.
Figure 5:
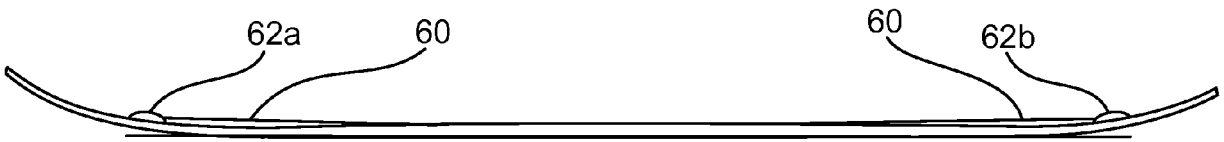
FIG. 5 is a side view of the ski of FIG. 4.
Figure 7:
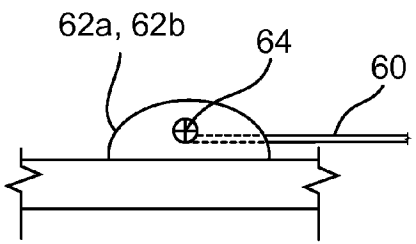
FIG. 7 is a side view of the tensioning system of FIG. 6.
Figure 6:
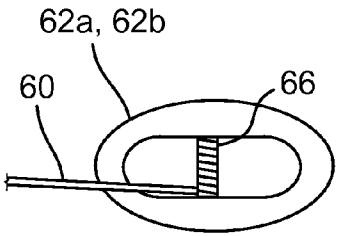
FIG. 6 is a top view of a tensioning system for use in the ski of FIG. 4.

Referring to FIGS. 4 and 5, in some embodiments, a tensioning system 58 is secured to the ski 10 to adjust the camber of the ski 10. The tensioning system includes a cable 60 extending between the forward and rearward ends of the ski 10. Anchors 62*a*, 62*b* secure the cable 60 to the ski 10. In the binding section 16, the cable 60 passes beneath the outer surface of the ski, such as through a channel formed in the ski 10. Near the forward and rearward ends of the ski, the cable 60 may be exposed. Referring to FIGS. 6 and 7, one or both of the anchors 62*a*, 62*b* includes a tensioning screw 64 having the cable 60 wrapped around the shaft 66. The screw 64 is mounted within a high friction or ratcheting mount such that tension applied to the cable is maintained. A user wishing to adjust the camber of the ski 10 may use a screwdriver to tighten or loosen the cable 60.

Alternatively, the cable running along the fore-body of the ski is independently adjustable from the cable running along the aft-body of the ski. Preferably, this is accomplished by fixing the cable fore and aft of the binding. Then the adjustment mechanisms can independently adjust the tension. This may be desirable for fine tuning the ski based on the terrain (e.g., a stiffer aft-body for steep powder skiing). The cable may alternatively be fixed under the binding or separate fore and aft cables may be used.

A homing device broadcasting a signal detectable to pinpoint the location of the ski may also be secured to the ski. It may be part of the structure of the ski or attached with other systems, such as the binding or tensioning system. In the event the ski binding releases in deep snow, the ski often becomes buried and lost. The homing device enables the skier to locate the ski.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A snow-riding device having edges running along sides thereof and an undersurface between a forward end and a rearward end, the device comprising:

a tip at the forward end;

a tail at the rearward end;

a mid-portion having a waist, a forward end, and a rearward end, the waist having a width smaller than the average of the widths of the mid-portion forward and rearward ends, such that a concave sidecut is created along the mid-portion;

a fore-body between the tip and the forward end of the mid-portion, the fore-body having a rearward end where it meets the mid-portion and a forward end where it meets the tip, the fore-body being widest at its rearward end and being straight or convex along its side to its forward end, the sides of the fore-body converging towards the tip; and an aft-body between the rearward end of the mid-portion and the tail, the aft-body having a rearward end where it meets the tail and a forward end where it meets the mid-portion, the aft-body being wider at its forward end than at its rearward end;

wherein, the fore-body is rockered along most of its undersurface, whereas the undersurface of the mid-portion is cambered, camber extending between a fore-body/mid-portion transition to a mid-portion/aft-body transition, such transitions also coinciding with the sidecut transitioning from concave to straight or convex and also being the widest regions of the device.

2. The device of claim 1, wherein the device includes a longitudinally rockered undersurface along most of the aft-body.

3. The device of claim 1, wherein the width of the device at the fore-body/mid-portion transition is greater than the width at the mid-portion/aft-body transition.

4. The device of claim 2, wherein the rearward end of the aft-body is higher than the forward end of the fore-body relative to a plane extending across the lowest portions of the undersurface.

5. The device of claim 1, wherein the forward end of the fore-body is wider than the rearward end of the aft-body.

6. The device of claim 1, wherein the length of the mid-portion forms between about 20% and about 60% of a total length of the device.

7. The device of claim 6, wherein the length of the mid-portion forms between about 25% and about 40% of the total length of the device.

8. The device of claim 7, wherein the mid-portion forms about 32% of the total length of the device.

9. The device of claim 6, wherein the waist of the mid-portion is narrower than the forward and rearward ends of the mid-portion.

10. The device of claim 1, wherein the mid-portion is adapted to receive a binding and wherein the mid-portion has a length substantially equal to a length of the binding.

11. The device of claim 1, wherein the waist of the mid-portion has a width between 1% and 10% less than a widest width along the device.

12. The device of claim 11, wherein the waist of the mid-portion has a width between 1.2% and 5% less than the widest width along the device.

13. The device of claim 11, wherein the widest width along the device is where the forward end of the mid-portion meets the rearward end of the fore-body.

14. The device of claim 13, wherein the rearward end of the aft-body is narrower than the forward end of the fore-body.

15. The device of claim 1, wherein the sides of the fore-body are substantially straight.

16. The device of claim 1, wherein the sides of the aft-body are substantially straight.

17. The device of claim 1, wherein the sides of the fore-body are substantially convex.

18. The device of claim 1, further comprising a camber adjustment mechanism engaging the device to adjust the camber of the undersurface.

19. The device of claim 18, wherein the camber adjustment mechanism comprises a cable secured to the device forward of the mid-portion and rearward of the mid-portion and a tensioner engaging the cable and ski to enable adjustment of the tension of the cable.

20. A snow riding device comprising:

a shovel end and a tail end each having a raised tip portion;

a sliding surface formed on an underside of the device extending between the shovel end and tail end;

a binding secured to an upper surface of a central portion of the device; and sidewalls comprising:

a concave portion formed along the central portion having concave sidecuts; and non-concave portions extending beyond the central portion from the concave sidecuts to the raised tip portions of the shovel end and tail end, the non-concave portions converging towards the tip portions;

wherein substantially all of the sliding surfaces coinciding with the non-concave portions of the sidewalls are rockered and substantially all of the sliding surface in the central portion is cambered.

21. The device of claim 20, wherein the non-concave sidecut portions increase in width moving from just inward of the raised tip portions toward the concave sidecut portion, and wherein the widest portion of the device is at a transition between the concave portion and the non-concave portion extending toward the shovel end of the device.

22. The device of claim 20, wherein the central portion of the device is being between the shovel and tail ends, the shovel end being wider than the tail end.

23. The device of claim 20, wherein the concave sidecut portion forms between about 20% and about 40% of a total length of the device.

24. The device of claim 23, wherein the device has a narrowest point at the concave sidecut portion having a width between 1% and 10% less than the widest point of the device.

25. The device of claim 24, wherein the concave sidecut portion forms between about 25% and about 35% of the total length of the device.

26. The device of claim 25, wherein the device has a narrowest point at the concave sidecut portion having a width between 1.2% and 5% less than the widest point of the device.

27. The device of claim 26, wherein the concave sidecut portion forms about 30% of the total length of the device.

28. The device of claim 27, wherein the device has a narrowest point at the concave sidecut portion having a width about 1.5% less than the widest point of the device.

29. The device of claim 28, wherein the concave sidecut portion forms about 32% of the total length of the device.

30. The device of claim 20, further comprising a camber adjustment mechanism engaging the device to adjust the camber of the undersurface.

31. The device of claim 30, wherein the camber adjustment mechanism comprises a cable secured to the device proximate the shovel and tail ends and a tensioner engaging one or more of the cable and ski to enable adjustment of the tension of the cable.

32. A snow riding device comprising:

a shovel end and a tail end each having a raised tip portion;

a sliding surface formed on an underside of the device extending between the shovel end and tail end;

a binding region on an upper surface of a central portion of the device; and sidewalls comprising:

a concave portion formed in the central portion having concave sidecuts; and non-concave portions extending from the concave sidecuts to the raised tip portions of the shovel end and tail end, wherein an uppermost point of the tail end is higher than an uppermost point of the shovel end relative to a horizontal plane parallel to the sliding surface proximate the central portion.

33. A snow riding device, having edges running along sides thereof and an undersurface between a forward end and a rearward end, the device comprising:

a tip at the forward end;

a tail at the rearward end;

a mid-portion having a waist, a forward end, and a rearward end, the waist having a width smaller than the average of the widths of the mid-portion forward and rearward ends, such that a concave sidecut is created along the mid-portion; and a fore-body between the tip and the forward end of the mid-portion, the fore-body having a rearward end where it meets the mid-portion and a forward end where it meets the tip, the fore-body being widest at its rearward end and being generally straight or convex along its side to its forward end, the sides of the fore-body converging towards the tip;

wherein, the fore-body is rockered along substantially all of its undersurface, whereas substantially all of the undersurface of the mid-portion is cambered, a transition between the mid-portion and the fore-body forming a widest region of width along the device, the sides converging toward the tip beyond the transition.

34. The device of claim 33, further comprising an aft-body between the rearward end of the mid-portion and the tail, the aft-body having a rearward end where it meets the tail and a forward end where it meets the mid-portion; wherein the aft body is longitudinally rockered along substantially all of the length of its undersurface.

35. The device of claim 34, wherein the aft-body is wider at its forward end than at its rearward end.

36. The device of claim 33, further comprising an aft-body between the rearward end of the mid-portion and the tail, the aft-body having a rearward end where it meets the tail and a forward end where it meets the mid-portion; wherein the aft-body is wider at its forward end than at its rearward end.

* * * * *